US009447664B2

(12) United States Patent
Pettinato et al.

(10) Patent No.: US 9,447,664 B2
(45) **Date of Patent: *Sep. 20, 2016**

(54) MULTI-ZONE FORMATION EVALUATION SYSTEMS AND METHODS

(75) Inventors: Miguel H. Pettinato, Comodoro Rivadavia (AR); Federico Sorenson, San Isidro (AR); Robert F. Shelley, Katy, TX (US); Saul Plavnik, Rio de Janiero (BR); Ricardo Jorquera, Quito (EC)

(73) Assignee: Halliburton Energy Services, Inc., Houston, TX (US)

( * ) Notice: Subject to any disclaimer, the term of this patent is extended or adjusted under 35 U.S.C. 154(b) by 869 days.

This patent is subject to a terminal disclaimer.

(21) Appl. No.: 13/028,474

(22) Filed: Feb. 16, 2011

(65) Prior Publication Data

US 2011/0132601 A1 Jun. 9, 2011

Related U.S. Application Data

(63) Continuation of application No. 11/561,524, filed on Nov. 20, 2006, now Pat. No. 8,132,621.

(51) Int. Cl.

| | |
|---|---|
| ***E21B 49/08*** | (2006.01) |
| ***E21B 43/14*** | (2006.01) |
| ***E21B 43/12*** | (2006.01) |

(52) U.S. Cl.

CPC ..... *E21B 43/124* (2013.01); *E21B 43/14* (2013.01); *E21B 49/084* (2013.01); *E21B 49/087* (2013.01)

(58) Field of Classification Search

CPC .... E21B 43/124; E21B 49/087; E21B 43/14; E21B 49/084; E21B 43/125; E21B 43/126; E21B 43/127; E21B 43/128; E21B 43/129; E21B 49/08

USPC ..... 166/250.01, 264, 373, 77.2

See application file for complete search history.

(56) References Cited

U.S. PATENT DOCUMENTS

| | | | |
|---|---|---|---|
| 4,434,653 | A | 3/1984 | Montgomery |
| 4,534,426 | A | 8/1985 | Hooper |

(Continued)

FOREIGN PATENT DOCUMENTS

| | | | |
|---|---|---|---|
| CA | 2620016 | A1 | 4/2007 |
| EP | 0953726 | A1 | 11/1999 |
| WO | 2007039836 | A1 | 4/2007 |

OTHER PUBLICATIONS

Canadian Office Action issued Jul. 19, 2011 for CA Patent Application No. 2,610,525, 7 pages.

(Continued)

*Primary Examiner* — Elizabeth Gitlin
(74) *Attorney, Agent, or Firm* — Chamberlain Hrdlicka

(57) ABSTRACT

A formation evaluation system and method. A formation evaluation system includes an assembly interconnected as part of a tubular string and displaceable to multiple positions proximate each of multiple zones intersected by a wellbore. The assembly includes at least one formation evaluation instrument for determining a characteristic of formation fluid, and a pump which draws the fluid into the assembly. A method of evaluating multiple subterranean zones during a single trip into a wellbore includes the steps of: interconnecting a formation evaluation assembly in a coiled tubing string; for each of the multiple zones, displacing the formation evaluation assembly to a position proximate the respective zone, receiving formation fluid from the respective zone into the formation evaluation assembly, and determining at least one characteristic of the formation fluid; and performing the multiple displacing, receiving and determining steps during the single trip of the coiled tubing string into the wellbore.

23 Claims, 7 Drawing Sheets

(56) References Cited

U.S. PATENT DOCUMENTS

| | | | | |
|---|---|---|---|---|
| 4,605,069 | A | 8/1986 | McClaflin et al. | |
| 4,753,292 | A | 6/1988 | Ringgenberg et al. | |
| 4,883,123 | A | 11/1989 | Zunkel et al. | |
| 5,318,130 | A | 6/1994 | Manke | |
| 5,327,971 | A | 7/1994 | Garbutt et al. | |
| 5,329,811 | A | 7/1994 | Schultz et al. | |
| 5,337,838 | A * | 8/1994 | Sorensen | 175/59 |
| 5,520,046 | A * | 5/1996 | Sornein et al. | 73/152.23 |
| 5,540,280 | A | 7/1996 | Schultz et al. | |
| 5,540,281 | A * | 7/1996 | Round | 166/250.17 |
| 5,555,945 | A | 9/1996 | Schultz et al. | |
| 5,675,674 | A * | 10/1997 | Weis | 385/12 |
| 5,741,962 | A | 4/1998 | Birchak et al. | |
| 5,826,662 | A | 10/1998 | Beck et al. | |
| 5,934,371 | A * | 8/1999 | Bussear et al. | 166/53 |
| 5,992,520 | A | 11/1999 | Schultz et al. | |
| 6,006,834 | A | 12/1999 | Skinner | |
| 6,073,698 | A | 6/2000 | Schultz et al. | |
| 6,325,146 | B1 | 12/2001 | Ringgenberg et al. | |
| 6,328,103 | B1 | 12/2001 | Pahmiyer et al. | |
| 6,340,062 | B1 | 1/2002 | Skinner | |
| 6,378,364 | B1 | 4/2002 | Pelletier et al. | |
| 6,446,719 | B2 | 9/2002 | Ringgenberg et al. | |
| 6,446,720 | B1 | 9/2002 | Ringgenberg et al. | |
| 6,527,052 | B2 | 3/2003 | Ringgenberg et al. | |
| 6,622,554 | B2 | 9/2003 | Manke et al. | |
| 6,729,398 | B2 | 5/2004 | Ringgenberg et al. | |
| 6,748,328 | B2 | 6/2004 | Storm, Jr. et al. | |
| 6,799,117 | B1 | 9/2004 | Proett et al. | |
| 6,843,118 | B2 | 1/2005 | Weintraub et al. | |
| 6,880,634 | B2 | 4/2005 | Gardner et al. | |
| 7,428,924 | B2 | 9/2008 | Patel | |
| 7,628,209 | B2 * | 12/2009 | Berry et al. | 166/369 |
| 8,132,621 | B2 | 3/2012 | Pettinato et al. | |
| 2003/0094040 | A1 | 5/2003 | Proett et al. | |
| 2003/0221829 | A1 | 12/2003 | Patel et al. | |
| 2004/0094296 | A1 | 5/2004 | Richards et al. | |
| 2004/0149437 | A1 | 8/2004 | Ringgenberg et al. | |
| 2004/0163803 | A1 | 8/2004 | Ringgenberg et al. | |
| 2004/0163808 | A1 | 8/2004 | Ringgenberg et al. | |
| 2004/0251022 | A1 | 12/2004 | Smith | |
| 2006/0101905 | A1 | 5/2006 | Bittleston et al. | |
| 2006/0196660 | A1 | 9/2006 | Patel | |
| 2007/0044960 | A1 | 3/2007 | Lovell et al. | |
| 2009/0288824 | A1 * | 11/2009 | Fowler et al. | 166/250.17 |

OTHER PUBLICATIONS

TAM International, "Locating and Controlling Water Production in Horizontal Wells," dated 2000, 15 pages.

Mike Connell, et al., "The Y-Block Logging System: An Alternative Method of Logging with Coiled Tubing," dated Feb. 5-7, 1996, 10 pages.

R.R. Jackson, et al., "Advances in Multilayer Reservoir Testing and Analysis using Numerical Well Testing and Reservoir Simulation," SPE 62917, dated Oct. 1-4, 2000, 14 pages.

Office Action issued Feb. 5, 2009 for U.S. Appl. No. 11/561,524, 27 pages.

Office Action issued Sep. 18, 2009 for U.S. Appl. No. 11/561,524, 12 pages.

Office Action issued Feb. 5, 2010 for U.S. Appl. No. 11/561,524, 12 pages.

Office Action issued Sep. 2, 2010 for U.S. Appl. No. 11/561,524, 10 pages.

Office Action issued Jan. 24, 2011 for U.S. Appl. No. 11/561,524, 11 pages.

Office Action issued Dec. 14, 2010, for Canadian Patent Application No. 2,610,525, 5 pages.

Office Action issued May 6, 2010, for Canadian Patent Application Serial No. 2,610,525, 7 pages.

Office Action issued Oct. 15, 2009, for Canadian Patent Application Serial No. 2,610,525, 11 pages.

* cited by examiner

MULTI-ZONE FORMATION EVALUATION SYSTEMS AND METHODS

CROSS-REFERENCE TO RELATED APPLICATION

The present application is a continuation of U.S. application Ser. No. 11/561,524 filed on Nov. 20, 2006. The entire disclosure of this prior application is incorporated herein by this reference.

BACKGROUND

The present invention relates generally to equipment and operations utilized in conjunction with subterranean wells and, in an embodiment described herein, more particularly provides a multi-zone formation evaluation system and method.

It can be quite time-consuming and, therefore, costly to perform formation evaluation tests for each of multiple zones intersected by a wellbore. In general, most conventional formation testing methods require a separate trip into the wellbore for each zone to be tested.

Therefore, it will be appreciated that it would be very beneficial to provide improved systems and methods for testing multiple zones. These improved systems and methods could, for example, enable multiple zones to be tested in a single trip into a wellbore. If multiple trips are required, the improved systems and methods could at least reduce the time spent for each of the formation evaluation tests.

SUMMARY

In carrying out the principles of the present invention, a formation evaluation system and method are provided which solve at least one problem in the art. One example is described below in which multiple zones can be conveniently tested during a single trip into a well, e.g., using jointed pipe or another type of tubular string to run it in a wellbore. Another example is described below in which coiled tubing is used to convey a formation evaluation assembly into a well for testing multiple zones.

The systems and methods described herein are preferably for use in hydrocarbon production wells. However, the systems and methods may be used in any type of well in keeping with the principles of the invention.

In one aspect of the invention, a method of evaluating multiple subterranean zones during a single trip into a wellbore is provided. The method includes the steps of: interconnecting a formation evaluation assembly in a coiled tubing string; and for each of the multiple zones, displacing the coiled tubing string including the formation evaluation assembly to a position proximate the respective zone, receiving formation fluid from the respective zone into the formation evaluation assembly, and determining at least one characteristic of the formation fluid.

The multiple displacing, receiving and determining steps may be performed during the single trip of the coiled tubing string into the wellbore. In some embodiments, the formation fluid may be flowed to a surface location. Wired or wireless telemetry may be used to transmit data indicative of the characteristic of the formation fluid to a remote location, such as the surface location.

A jet pump, or another type of pump, may be used to draw the formation fluid from a formation into the formation evaluation assembly inside the wellbore. The pump may be in one of multiple adjacent passages, another one of which allows an instrument to be displaced therethrough for evaluation of the formation fluid.

In another aspect of the invention, a formation evaluation system is provided. The system includes a formation evaluation assembly interconnected as part of a tubular string. The formation evaluation assembly is displaceable using the tubular string to multiple positions in a wellbore proximate multiple respective zones intersected by the wellbore.

The formation evaluation assembly includes at least one formation evaluation instrument for determining a characteristic of formation fluid received from each respective zone into the formation evaluation assembly, and a pump which draws the formation fluid into the formation evaluation assembly. The pump may operate in response to flow of pressurized annulus fluid into the pump from an annulus formed between the tubular string and the wellbore.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
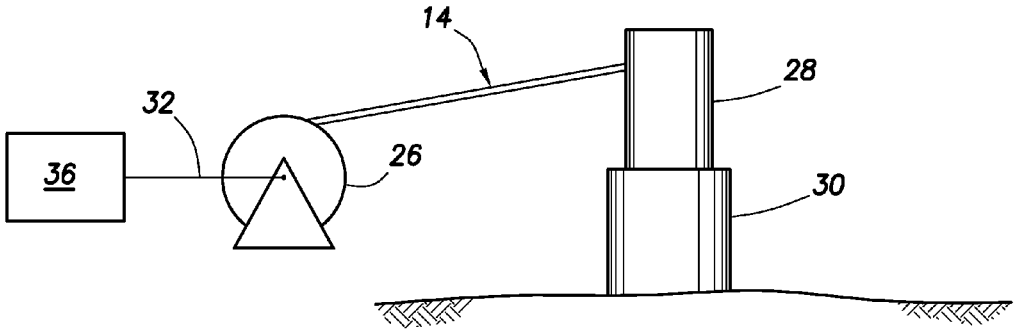
FIG. 1 is a schematic partially cross-sectional view of a formation evaluation system and associated method embodying principles of the present invention.
Figure 1:
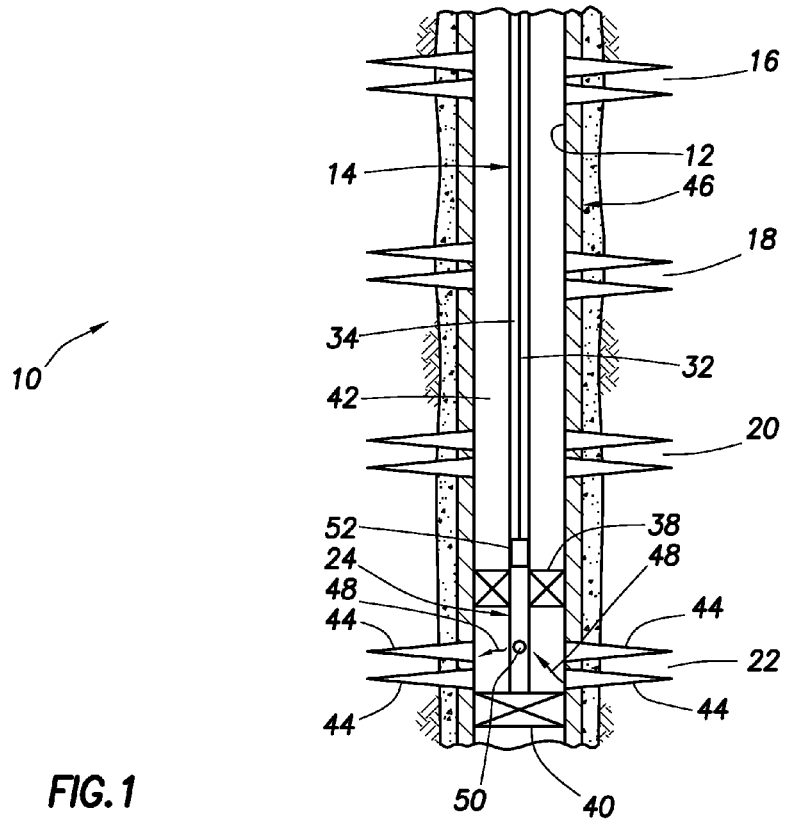

Representatively illustrated in FIG. 1 is a formation evaluation system 10 and associated method which embody principles of the present invention. The system 10 and methods are depicted in various configurations in the drawings as being used in a cased wellbore 12, but with suitable modifications the system and method could be used in uncased wellbores, as well.

As shown in FIG. 1, a tubular string 14 has been installed in the wellbore 12 for the purpose of evaluating multiple zones 16, 18, 20, 22 intersected by the wellbore. For this purpose, a formation evaluation assembly 24 is interconnected as a part of the tubular string 14.

The zones 16, 18, 20, 22 may be portions of a common formation or reservoir, or one or more of the zones may be portion(s) of separate formations or reservoirs. Although four of the zones 16, 18, 20, 22 are depicted in FIG. 1, any number of zones (including one) may be tested with the system 10.

In one important feature of the system 10, all of the zones 16, 18, 20, 22 can be conveniently and relatively quickly tested in a single trip of the tubular string 14 into the wellbore 12 using the formation evaluation assembly 24. The term "single trip" is well known to those skilled in the art, and as used herein the term indicates an operation commencing with an initial insertion of the tubular string 14 into the wellbore 12, and ending with a next subsequent complete retrieval of the tubular string from the wellbore.

As depicted in FIG. 1, the tubular string 14 is preferably a coiled tubing string of the type which is initially delivered to a wellsite wrapped about a spool 26. To insert the tubular string 14 into the wellbore 12, equipment such as an injector head 28 may be mounted on a wellhead 30.

In the embodiment illustrated in FIG. 1, at least one conductor 32 is received within the tubular string 14. The conductor 32 is preferably installed within the tubular string 14 prior to insertion of the tubular string into the wellbore 12 (for example, the conductor may be installed in the coiled tubing string prior to its delivery to the wellsite, etc.), but the conductor could be installed after the tubular string is positioned in the wellbore, if desired.

The conductor 32 may be part of a cable assembly which includes multiple conductors. The cable assembly may be positioned in an interior passage 34 of the tubular string 14, in a sidewall of the tubular string, or otherwise incorporated as a part of the tubular string.

The conductor 32 could instead be positioned external to the tubular string 14, if desired. For example, the conductor may be included as part of a cable assembly installed alongside the tubular string as the tubular string is installed.

The conductor 32 may conduct electricity, light or another form of energy capable of transmitting data, power, command signals, etc. In some embodiments of the system 10, the conductor 32 may not be used. In those embodiments, power may be otherwise provided to the formation evaluation assembly 24 (such as by batteries, downhole power generation, etc.), and data and command signals may be transmitted by wireless telemetry (such as acoustic, pressure pulse or electromagnetic telemetry, etc.).

In the embodiment illustrated in FIG. 1, the conductor 32 is preferably connected to a computerized system 36 which supplies power, receives, records and processes data, communicates command and control signals, and otherwise facilitates the testing and evaluation of the zones 16, 18, 20, 22 using the formation evaluation assembly 24. The computerized system 36 is preferably positioned at a surface location (for example, near the spool 26, injector head 28, wellhead 30, etc.), but the computerized system or any portion of it could be located elsewhere, if desired (for example, communication could be provided via satellite transmission, Internet transmission, etc.).

The formation evaluation assembly 24 preferably includes one or more packers 38, 40 for isolating a portion of an annulus 42 adjacent each of the zones 16, 18, 20, 22 when each respective zone is being tested. As depicted in FIG. 1, the annulus 42 above and below the zone 22 is sealed off by the packers 38, 40 straddling perforations 44 formed through a casing string 46. Of course, if the wellbore 12 is uncased, the perforations 44 would not be used, and the packers 38, 40 may be of the type (such as inflatable) which are designed to seal against uncased wellbores.

In this manner, formation fluid 48 may be flowed from the zone 22 into the assembly 24 (such as via an opening 50 in the assembly) for determination of one or more characteristics of the fluid. For this purpose, the assembly 24 preferably includes a set of formation evaluation instruments 52, which may comprise sensors (such as pressure, temperature, flow rate, density, fluid identification, resistivity, capacitance, water cut or any other type of sensor or combination of sensors), flow control devices (such as valves, chokes, etc.) and samplers.

Some or all of the instruments 52 may be retrievable from the well. For example, a memory module which contains recorded data could be retrieved and/or re-installed using the conductor 32 or other means.

The characteristics of the formation fluid 48 (including changes in the characteristics over time, changes in the characteristics in response to induced stimulus, etc.) are used to evaluate the properties of the zone 22, its associated formation or reservoir, the fluid therein, etc. These evaluations or any portion of them may be performed in the assembly 24 itself, in the computerized system 36 or at any other location.

Due to the unique configuration of the system 10, each of the multiple zones 16, 18, 20, 22 can be evaluated in this manner by merely repositioning the assembly 24 in the wellbore 12 adjacent a respective one of the zones, setting the packers 38, 40 straddling the respective perforations, and receiving formation fluid from the respective zone into the assembly. The use of coiled tubing for the tubular string 14 makes the installation, repositioning and eventual retrieval operations more convenient and less time-consuming. However, other types of tubular strings may be used, if desired, such as jointed or segmented tubular strings.

The assembly 24 may include a pump (not shown in FIG. 1) for drawing the formation fluid 48 into the assembly and/or for flowing the fluid to the surface for further evaluation. If the zone 22 is sufficiently pressurized, permeable, etc., then the formation fluid 48 may flow into the assembly 24 and/or to the surface without the aid of a pump.

Note that it is not necessary for the formation fluid 48 to be flowed to the surface. After being received into the assembly 24, the fluid 48 could instead be flowed back into the zone 22 in order to avoid flowing it to the surface.

The formation fluid 48 could be flowed into the zone 22 as part of the formation evaluation tests (for example, in an injectivity test), whether or not the fluid is also flowed to the surface. The pump of the assembly 24 could be used to flow the fluid 48 into the zone 22, as well as to flow the fluid from the zone into the assembly, or separate pumps could be used for these purposes, if desired.

Figure 2:
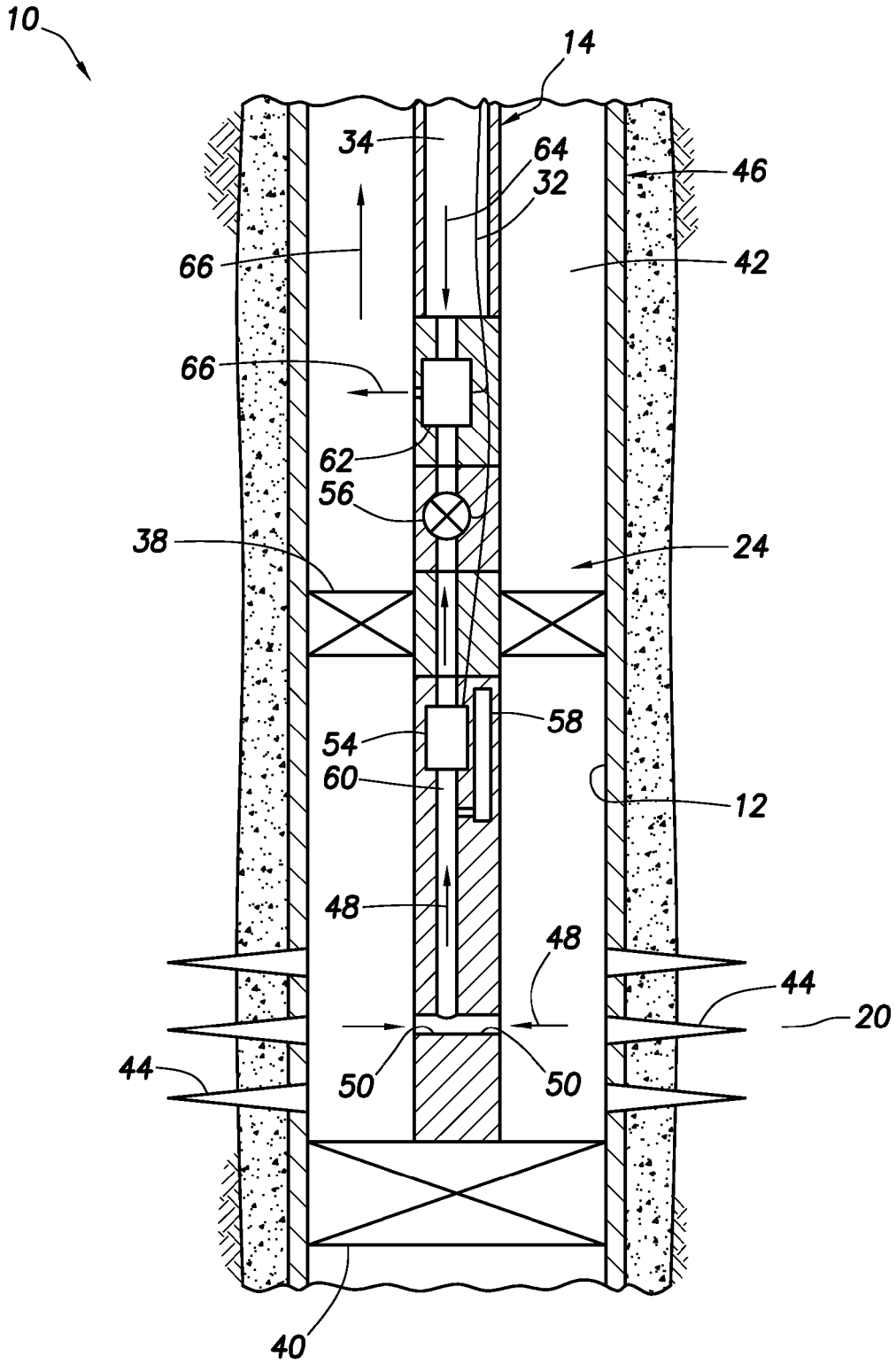
FIG. 2 is an enlarged scale schematic cross-sectional view of the formation evaluation system.

Referring additionally now to FIG. 2, an enlarged scale schematic view of one configuration of the formation evaluation assembly 24 is representatively illustrated. In this view it may be seen that the instruments 52 of the assembly 24 can include sensors 54, a flow control device 56 and a sampler 58 connected to an internal passage 60 of the assembly. However, it should be clearly understood that the sensors 54, flow control device 56 and sampler 58 are merely examples of the wide variety of instrument types and combinations which may be used in the assembly 24.

As depicted in FIG. 2, the assembly 24 is positioned adjacent the zone 20, with the packers 38, 40 set straddling perforations 44 providing fluid communication between the zone and the interior of the casing string 46. A pump 62 is used to draw the formation fluid 48 from the zone 20 and into the assembly 24, wherein the sensors 54 may be used to determine characteristics of the fluid, a sample of the fluid may be obtained using the sampler 58, etc.

A drawdown test may be performed by operating the pump 62 to draw the fluid 48 into the assembly 24 while recording characteristics such as pressure, temperature, flow rate, etc. using the sensors 54. A pressure buildup test may be performed by closing the passage 60 using the flow control device 56 and recording characteristics such as pressure, temperature, etc. using the sensors 54.

The conductor 32 is shown in FIG. 2 as being connected to the sensors 54 and flow control device 56 for communication of data, control signals, power, etc. The conductor 32 could also be connected to the sampler 58, if desired.

The pump 62 is representatively illustrated in FIG. 2 as being a fluid operated pump, such as a turbine pump, hydraulic pump or a jet pump. Fluid 64 may be circulated through the passage 34 in the tubular string 14, through the pump 62 and into the annulus 42 in order to operate the pump.

A mixture 66 of the fluid 64 circulated through the tubular string 14 to operate the pump 62 and the formation fluid 48 received in the assembly 24 from the zone 20 may be discharged from the pump and circulated to the surface via the annulus 42. However, various other flow paths may be used in other configurations of the assembly 24, some of which are described below.

The conductor 32 is depicted in FIG. 2 as being connected to the pump 62, for example, to monitor the pump performance, measure pressure differential across the pump, etc. Instead of being pressure operated, the pump 62 could be operated electrically using power supplied via the conductor 32, if desired.

Figure 2A:
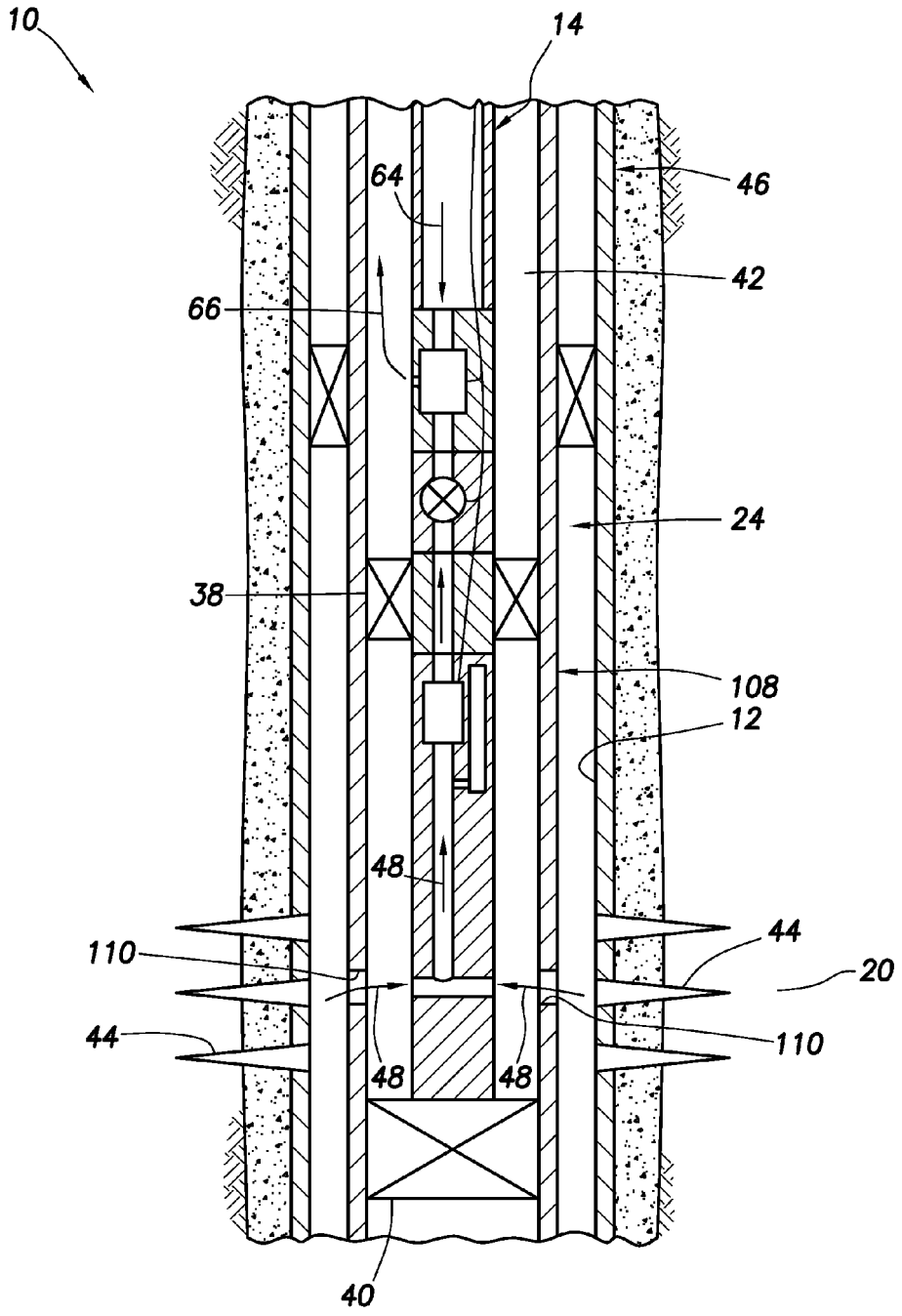
FIG. 2A is a schematic cross-sectional view of a first alternate configuration of the formation evaluation system.

Referring additionally now to FIG. 2A, an alternate configuration of the formation evaluation assembly 24 of FIG. 2 is representatively illustrated. In this configuration, the assembly 24 is received in another tubular string 108 (such as a production tubing string or other type of tubing string) positioned within the casing string 46.

The formation fluid 48 is received into the tubular string 108 via openings 110 therein. The packers 38, 40 are set straddling the openings 110.

The fluid 64 is circulated through the tubular string 14 (as in the configuration of FIG. 2), but the fluid mixture 66 is flowed to the surface via the annulus 42 which is now formed between the tubular strings 14, 108. The annulus 42 is still between the tubular string 14 and the wellbore 12, but its outer extent is bounded by the tubular string 108 instead of by the casing string 46.

It should be understood that any of the embodiments of the formation evaluation assembly 24 described herein could be received in any type of tubular string, and in any number of overlapping tubular strings, in keeping with the principles of the invention.

Figure 3:
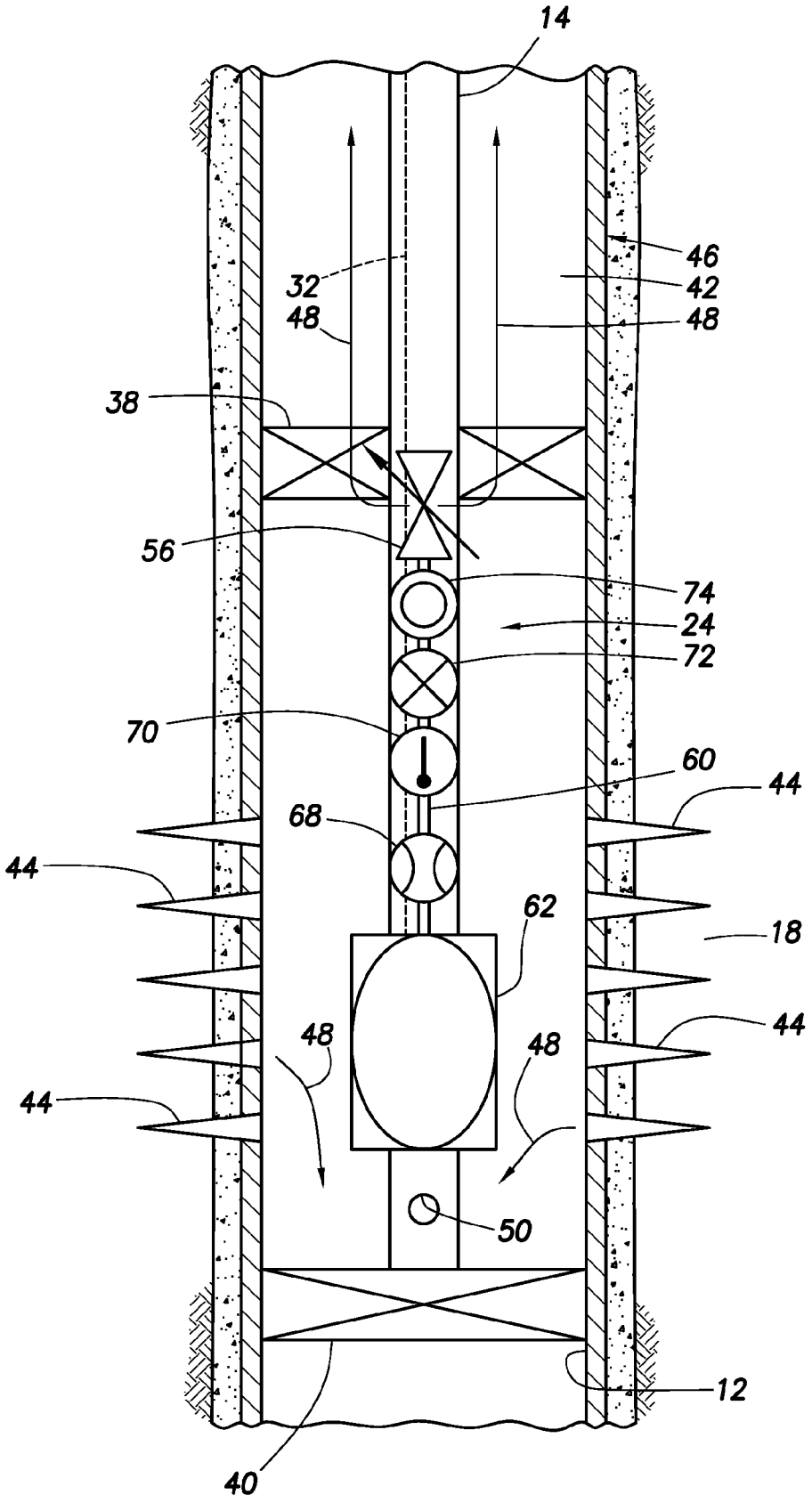
FIG. 3 is a schematic cross-sectional view of a second alternate configuration of the formation evaluation system.

Referring additionally now to FIG. 3, an alternate configuration of the formation evaluation assembly 24 is representatively illustrated. In this configuration, the pump 62 is preferably an electrically operated pump which is connected to the conductor 32.

In FIG. 3, the sensors 54 are depicted as comprising a flowmeter 68, a temperature sensor 70, a pressure sensor 72 and a fluid identification sensor 74. The flow control device 56 is depicted as being a variable choke. As described above, any types or combinations of sensors, flow control devices, samplers, etc. may be included in the assembly 24 in keeping with the principles of the invention.

The assembly 24 is illustrated in FIG. 3 as being repositioned adjacent the zone 18. The packers 38, 40 have been set straddling perforations 44 providing fluid communication between the zone 18 and the interior of the casing string 46.

The pump 62 draws the formation fluid 48 into the assembly 24 and flows the fluid through the sensors 68, 70, 72, 74 and flow control device 56. As depicted in FIG. 3, the fluid 48 is discharged from the flow control device 56 into the annulus 42 above the upper packer 38 and flows to the surface via the annulus, but in other configurations the fluid 48 could flow to the surface via the interior passage 34 of the tubular string 14, the fluid could be flowed back into the zone 18, etc.

Figure 4:
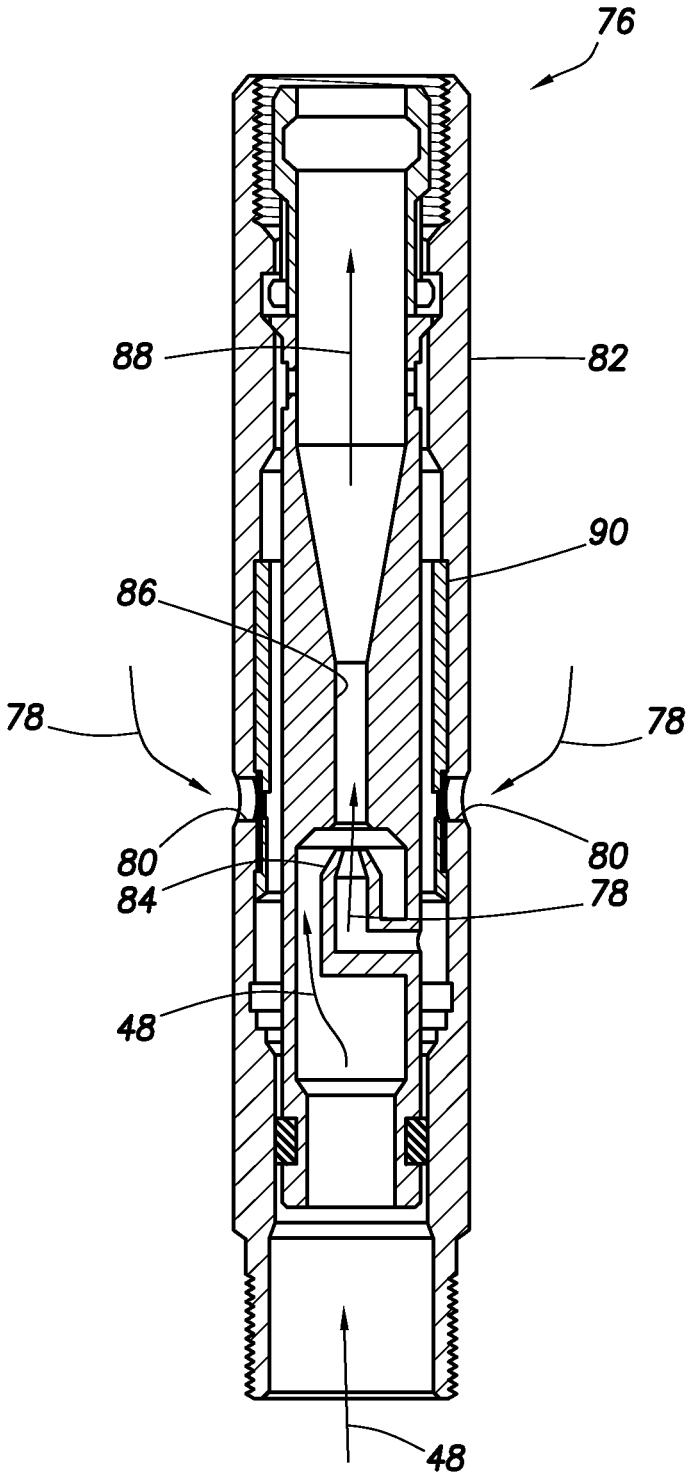
FIG. 4 is an enlarged scale schematic cross-sectional view of a pump which may be used in the various configurations of the formation evaluation system.

Referring additionally now to FIG. 4, an enlarged scale schematic cross-sectional view of a fluid operated pump 76 which may be used for the pump 62 in the assembly 24 is representatively illustrated. The pump 76 is of the type known to those skilled in the art as a jet pump, but other types of fluid operated pumps (such as turbine or hydraulic pumps) may be used instead in keeping with the principles of the invention.

In the configuration of the pump 76 depicted in FIG. 4, fluid 78 is circulated through the pump in order to draw the formation fluid 48 into the assembly 24. The fluid 78 enters openings 80 in an outer housing 82 of the pump 76 and then flows upwardly through a nozzle 84. The nozzle 84 is configured to increase a velocity of the fluid 78, thereby creating a region of reduced pressure about the nozzle exit.

Due to the reduced pressure, the formation fluid 48 is drawn into the pump 76 from a lower end thereof, where it mixes with the fluid 78 near the nozzle exit and flows upward through a venturi 86. Thus, a mixture 88 of the fluids 48, 78 exits the pump 76 from an upper end thereof.

In the configuration of FIG. 4, the nozzle 84 and venturi 86 are retrievable from within the outer housing 82, and thereafter a sliding sleeve 90 may be used to close off the openings 80. These features may or may not be used in the formation evaluation assembly 24 as illustrated in FIGS. 1-3.

Figure 5:
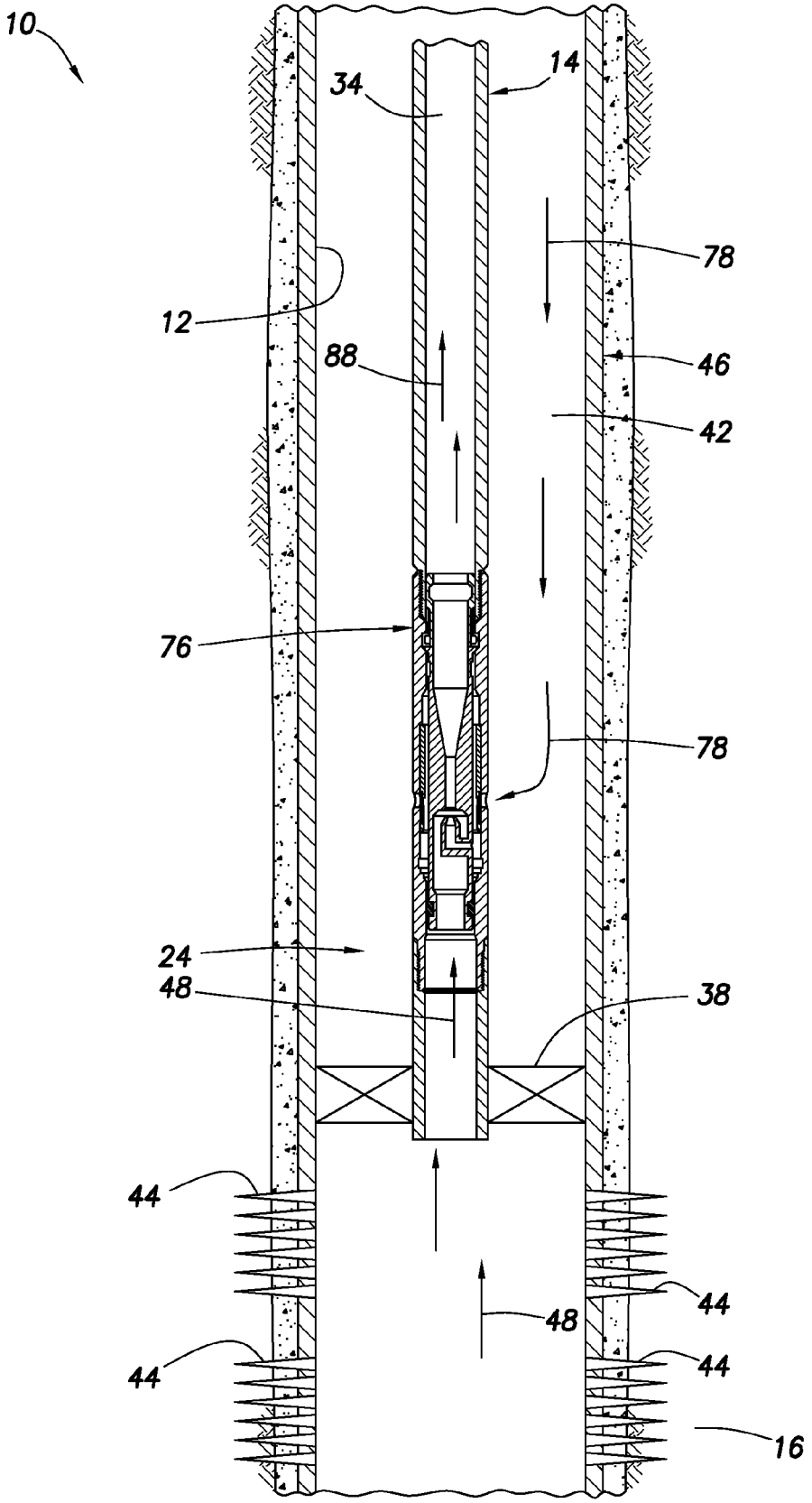
FIG. 5 is a schematic cross-sectional view of a third alternate configuration of the formation evaluation system.

Referring additionally now to FIG. 5, another alternate configuration of the formation evaluation assembly 24 is representatively illustrated, in which the pump 76 of FIG. 4 is incorporated into the assembly in place of the pump 62 depicted in FIG. 2. For clarity, other elements of the assembly 24 (such as the instruments 52, sensors 54, 68, 70, 72, 74, sampler 58, flow control device 56, etc.) are not shown in FIG. 5, but these elements may be provided in the assembly 24 as described above.

In addition, the lower packer 40 is not shown as being included in the assembly 24 of FIG. 5. Instead, a bridge plug (not shown) or other plugging device could be used to isolate the wellbore 12 below the perforations 44 providing fluid communication with the zone 16.

Note that the circulation of the fluid 78 from the annulus 42 to the interior passage 34 of the tubular string 14 as depicted in FIG. 5 is in an opposite direction as compared to the circulation of the fluid 64 from the interior passage to the annulus in the configuration of the assembly 24 depicted in FIG. 2. In addition, the mixture 88 of the fluids 48, 78 flows to the surface via the interior passage 34 of the tubular string 14 in the configuration of FIG. 5, whereas the mixture 66 of the fluids 48, 64 flows to the surface via the annulus 42 in the configuration of FIG. 2. It will, thus, be appreciated that various flow paths and flow directions of various fluids and mixtures of fluids (including flow paths, directions and mixtures not specifically described herein) may be used without departing from the principles of the invention.

Figure 6:
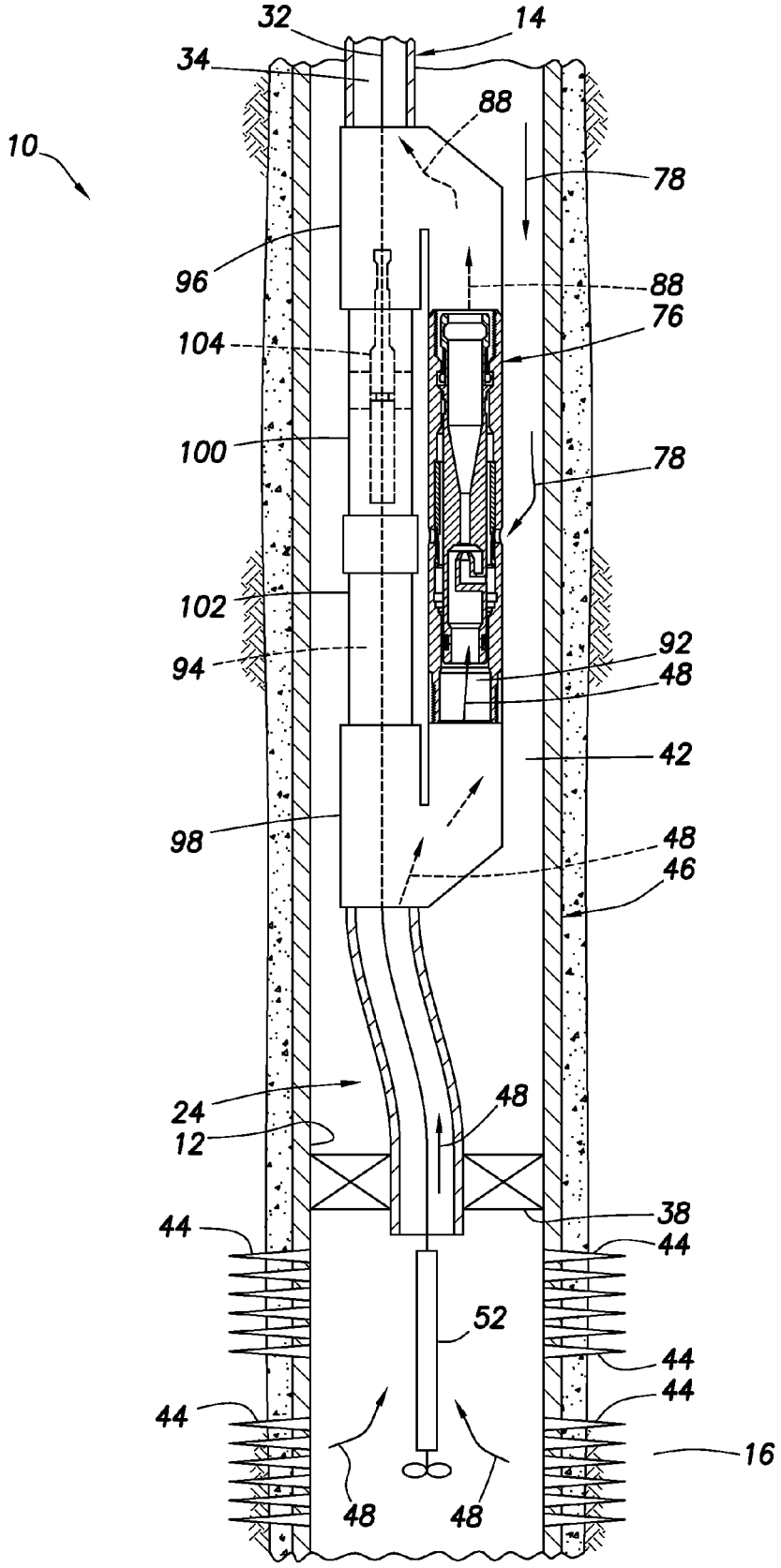
FIG. 6 is a schematic cross-sectional view of a fourth alternate configuration of the formation evaluation system.

Referring additionally now to FIG. 6, another alternate configuration of the formation evaluation assembly 24 is representatively illustrated. This configuration is similar in many respects to the configuration depicted in FIG. 5. Again, some elements of the assembly 24 (such as the sensors 54, 68, 70, 72, 74, sampler 58, flow control device 56, etc.) are not shown in FIG. 6 for clarity, but these elements may be provided in the assembly 24 as described above.

In this configuration of the assembly 24, adjacent parallel passages 92, 94 are provided so that the pump 76 may be interconnected in one of the passages, while access is provided through the other passage. The passages 92, 94 are in fluid communication with each other at opposite ends of the passages by means of two Y-blocks 96, 98.

As depicted in FIG. 6, the pump 76 is interconnected between the Y-blocks 96, 98, with the passage 92 extending through the pump between the Y-blocks. The other passage 94 is formed through a nipple 100 and a telescoping tube 102 interconnected between the Y-blocks 96, 98.

The nipple 100 is of the type which includes an internal landing profile and a seal bore for securing and sealing tools, such as a plug 104, therein. The plug 104 as shown in FIG. 6 provides for the conductor 32 to extend through the plug while still preventing flow through the passage 94.

In this embodiment, the conductor 32 is part of a wireline or slickline used to convey the plug 104 and instruments 52 into the assembly 24. The instruments 52 are positioned adjacent or above the perforations 44 and include sensors (such as pressure, temperature, flow rate, fluid identification, etc. sensors) for determining characteristics of the formation fluid 48. The instruments 52 could be provided, for example, in the form of a conventional wireline or slickline conveyed production logging tool.

The instruments 52 may be used to evaluate characteristics of more than one of the zones 16, 18, 20, 22. For example, the assembly 24 could be positioned above the upper zone 16, and the instruments 52 could be lowered to various positions relative to each of the zones 16, 18, 20, 22 to measure characteristics of the fluid 48 produced from each zone, the fluid produced from various combinations of the zones, etc.

In addition, the instruments 52 may be retrieved from the well at any time, without also retrieving the remainder of the assembly 24. For example, the instruments 52 could include one or more memory modules which record data for download at the surface. The instruments 52 could be retrieved and re-installed as many times as desired to acquire sufficient data for evaluation of the zones 16, 18, 20, 22.

If the instruments 52 include memory for recording of data therein, it may not be necessary for the conductor 32 to transmit data. For example, the conductor 32 could be a slickline which may not actually conduct electricity or other forms of energy in the system 10. In that case, the conductor 32 may be primarily a conveyance for installing, positioning and retrieving the instruments 52.

However, it should be understood that the instruments 52 could transmit data in real time (for example, via the conductor 32 or via telemetry, etc.) and/or the instruments could include memory to record data therein in any of the embodiments of the formation evaluation assembly 24 described herein.

As depicted in FIG. 6, the plug 104 prevents flow through the passage 94 while the pump 76 draws the formation fluid 48 into the assembly 24 and pumps the fluid upward through the tubular string 14. After the evaluation tests are complete, the instruments 52, plug 104 and conductor 32 may be retrieved from the tubular string 14, and the plug 104 may be replaced with another plug to prevent flow through the passage 94 if the pump 76 is to be used for further pumping of the fluid 48. Alternatively, the passage 94 may be left open if further access to the wellbore 12 below the packer 38 is desired.

It may now be fully appreciated that the various embodiments of the formation evaluation system 10 and methods described above provide a variety of benefits. The system 10 and methods enable convenient and efficient testing of multiple zones 16, 18, 20, 22 in a single trip into the well. The embodiments of FIGS. 5 & 6 may utilize multiple trips to accomplish tests of multiple zones (for example, to allow re-setting of a bridge plug, etc.), but the lower packer 40 could readily be added to these embodiments to allow single trip testing of multiple zones, if desired.

Furthermore, although the tubular string 14 has been described above as being preferably comprised of a coiled tubing string, segmented (or jointed) tubing could be used instead of continuous tubing if desired. For example, segmented tubing (such as production tubing) could be used for the tubular string 14 in the embodiments of FIGS. 5 & 6, if desired.

The spacing between the packers 38, 40 in the embodiments of the formation evaluation assembly 24 described above could be adjusted as needed to accommodate various lengths of zones or intervals along the wellbore 12. The spacing between the packers 38, 40 could be adjusted while the assembly 24 is in the wellbore 12, for example, by including a telescoping joint in the assembly between the packers.

Thus has been described the formation evaluation system 10 which includes the formation evaluation assembly 24 interconnected as part of the tubular string 14. The formation evaluation assembly 24 is displaceable using the tubular string 14 to multiple positions in the wellbore 12 proximate multiple respective zones 16, 18, 20, 22 intersected by the wellbore.

The formation evaluation assembly 24 includes at least one formation evaluation instrument 52 for determining a characteristic of formation fluid 48 received from each respective zone 16, 18, 20, 22 into the formation evaluation assembly, and a pump 72, 76 which in one embodiment draws the formation fluid into the formation evaluation assembly in response to flow of pressurized annulus fluid 78 into the pump from the annulus 42 formed between the tubular string 14 and the wellbore 12.

A method of evaluating the multiple subterranean zones 16, 18, 20, 22 during a single trip into the wellbore 12 has also been described. The method includes the steps of interconnecting the formation evaluation assembly 24 in a coiled tubing string 14; for each of the multiple zones, displacing the coiled tubing string including the formation evaluation assembly to a position proximate the respective zone, receiving formation fluid 48 from the respective zone into the formation evaluation assembly, and determining at least one characteristic of the formation fluid; and performing the multiple displacing, receiving and determining steps during the single trip of the coiled tubing string into the wellbore.

The method may also include the step of transmitting data indicative of the characteristic of the formation fluid 48 from the formation evaluation assembly 24 to a remote location, such as a surface location. The transmitting step may be performed using wireless telemetry. The wireless telemetry may be acoustic telemetry, or another form of wireless telemetry, such as pressure pulse or electromagnetic telemetry. Alternatively, the transmitting step may be performed using the conductor 32 within the coiled tubing string 14. In addition, the transmitting step may be performed during the determining step.

The step of receiving the formation fluid 48 into the formation evaluation assembly 24 may include flowing the formation fluid to a surface location. The formation fluid 48 may, for example, be flowed to the surface location through an interior of the coiled tubing string 14. Alternatively, the formation fluid 48 may be flowed to the surface location via the annulus 42.

The method may include the step of flowing the formation fluid 48 from the formation evaluation assembly 24 into the respective zone 16, 18, 20, 22, after the step of receiving the formation fluid into the formation evaluation assembly from the respective zone.

The method may include the step of providing the coiled tubing string 14 with adjacent passages 92, 94 in fluid communication with each other at opposite ends of the passages. The pump 76 may be interconnected in one of the passages 92. The formation evaluation instruments 52 may be displaced through the other passage 94. The pump 76 may be used to pump the formation fluid 48 through the passage 92 while using the formation evaluation instrument 52 to determine characteristics of the formation fluid.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention.

Accordingly, the foregoing detailed description is to be clearly understood as being given by way of illustration and example only, the spirit and scope of the present invention being limited solely by the appended claims and their equivalents.

What is claimed is:

1. A method of evaluating multiple subterranean zones during a single trip into a wellbore, the method comprising the steps of:

interconnecting a formation evaluation assembly in a coiled tubing string;

for each of the multiple zones, displacing the coiled tubing string including the formation evaluation assembly to a position proximate the respective zone, receiving formation fluid from the respective zone into the formation evaluation assembly by using a downhole pump to draw the formation fluid into the formation evaluation assembly, determining at least one characteristic of the formation fluid, and pumping a sample of the formation fluid to a surface location using the downhole pump; and performing the multiple displacing, receiving, determining, and pumping steps during the single trip of the coiled tubing string into the wellbore.

2. The method of claim 1, further comprising the step of transmitting data indicative of the characteristic of the formation fluid from the formation evaluation assembly to a remote location.

3. The method of claim 2, wherein the transmitting step is performed using wireless telemetry.

4. The method of claim 3, wherein the wireless telemetry is acoustic telemetry.

5. The method of claim 2, wherein the transmitting step is performed using a conductor within the coiled tubing string.

6. The method of claim 2, wherein the transmitting step is performed during the determining step.

7. The method of claim 1, wherein the pumping step further comprises pumping the formation fluid to the surface location through an interior of the coiled tubing string.

8. The method of claim 1, wherein the pumping step further comprises pumping the formation fluid to the surface location via an annulus formed between the coiled tubing string and the wellbore.

9. The method of claim 1, further comprising the step of flowing the formation fluid from the formation evaluation assembly into the respective zone, after the step of receiving the formation fluid into the formation evaluation assembly from the respective zone.

10. The method of claim 1, further comprising the step of providing the coiled tubing string with adjacent passages in fluid communication with each other at opposite ends of the passages.

11. The method of claim 10, further comprising the step of interconnecting the pump in a first one of the passages.

12. A method of evaluating multiple subterranean zones during a single trip into a wellbore, the method comprising the steps of:

interconnecting a formation evaluation assembly in a coiled tubing string; and for each of the multiple zones, displacing the coiled tubing string including the formation evaluation assembly to a position proximate the respective zone, receiving formation fluid from the respective zone into the formation evaluation assembly by using a downhole pump to draw the formation fluid into the formation evaluation assembly, determining at least one characteristic of the formation fluid, and flowing the formation fluid to a surface location using the downhole pump.

13. The method of claim 12, further comprising the step of transmitting data indicative of the characteristic of the formation fluid from the formation evaluation assembly to a remote location.

14. The method of claim 13, wherein the transmitting step is performed using wireless telemetry.

15. The method of claim 14, wherein the wireless telemetry is acoustic telemetry.

16. The method of claim 13, wherein the transmitting step is performed using a conductor within the coiled tubing string.

17. The method of claim 13, wherein the transmitting step is performed during the determining step.

18. The method of claim 12, wherein the flowing step further comprises flowing the formation fluid to the surface location through an interior of the coiled tubing string.

19. The method of claim 12, wherein the flowing step further comprises flowing the formation fluid to the surface location via an annulus formed between the coiled tubing string and the wellbore.

20. The method of claim 12, further comprising the step of flowing the formation fluid from the formation evaluation assembly into the respective zone, after the step of receiving the formation fluid into the formation evaluation assembly from the respective zone.

21. The method of claim 12, further comprising the step of providing the coiled tubing string with adjacent passages in fluid communication with each other at opposite ends of the passages.

22. The method of claim 21, further comprising the step of interconnecting the pump in a first one of the passages.

23. The method of claim 12, further comprising performing the multiple displacing, receiving, determining and flowing steps during the single trip of the coiled tubing string into the wellbore.

* * * * *